United States Patent [19]

Sweigart, Jr.

[11] 4,333,580

[45] Jun. 8, 1982

[54] MECHANISM FOR LOCKING TWO HALVES OF AN UNDERGROUND VAULT

[75] Inventor: Robert L. Sweigart, Jr., Arcadia, Calif.

[73] Assignee: Associated Plastics, Inc., Fountain Valley, Calif.

[21] Appl. No.: 191,396

[22] Filed: Sep. 29, 1980

[51] Int. Cl.[3] ..... B65D 8/04; B65D 41/06

[52] U.S. Cl. ..... 220/5 A; 220/293; 220/297; 220/300; 220/4 B; 220/4 E

[58] Field of Search ..... 220/5 R, 5 A, 293, 294, 220/295, 296, 297, 298, 299, 300, 4 B, 4 C

[56] References Cited

U.S. PATENT DOCUMENTS

| | | | |
|---|---|---|---|
| 193,686 | 7/1877 | Bowers . | |
| 211,164 | 1/1879 | Klein . | |
| 308,742 | 12/1884 | Borup . | |
| 492,227 | 2/1893 | O'Neil . | |
| 1,408,982 | 3/1922 | Calhoun . | |
| 2,693,343 | 11/1954 | Darin et al. . | |
| 2,919,937 | 1/1960 | Dovey . | |
| 3,221,881 | 12/1965 | Weiler et al. . | |
| 3,400,863 | 9/1968 | Brown . | |
| 3,514,010 | 5/1970 | Rossi | 220/293 |
| 3,854,582 | 12/1974 | Martinelli | 220/300 |

FOREIGN PATENT DOCUMENTS

| | | | |
|---|---|---|---|
| 1058230 | 5/1959 | Fed. Rep. of Germany | 220/297 |

*Primary Examiner*—George E. Lowrance

*Attorney, Agent, or Firm*—Knobbe, Martens, Olson, Hubbard & Bear

[57] ABSTRACT

An underground vault formed of two housing sections, each section having an open end bordered by an outwardly projecting annular flange, the flanges being of like diameter to permit their mutual abutment when the two sections are placed together to form an enclosure, each flange having a plurality of circumferentially located, equally spaced hooks and slot configurations to lock the sections together when the sections are positioned so that alternating hooks and slots of one section are aligned with slots and hooks of the other section is disclosed.

5 Claims, 6 Drawing Figures

MECHANISM FOR LOCKING TWO HALVES OF AN UNDERGROUND VAULT

BACKGROUND OF THE INVENTION

The present invention is directed to enclosures of underground structures commonly employed by power and water utilities, such as transformers, generators, pumps and the like. More specifically, the invention relates to a unique locking mechanism for underground vaults which house these structures.

Hardware, such as transformers, employed by utilities, is often buried underground in vaults for protection and space conservation. Typically, these vaults are formed of essentially cylindrical top and bottom sections with each having an open end of essentially the same diameter. The open ends are placed in mutual confrontation to form an enclosure about the transformer. The bottom of the enclosure is covered with a grate, and the enclosure with transformer is buried in the ground. The top, which is open, is covered with a frusto-conical cap which extends above ground level. This cap is in turn covered with a grate. Thus, although the transformer is safely protected below ground level, maintenance personnel have access to the structure through the open top when necessary.

The two sections of the vault must be securely locked together. Yet, it is preferable that the lock not be permanent so that the sections may be separated if desired. In the past, these sections have been secured by nails extending through the periphery of the two sections. Such a mechanism has proven unsatisfactory since the nails tend to rust and deteriorate when beneath the ground, causing a weakening of the bond.

U.S. Pat. No. 4,065,020, issued to Carson, discloses the use of legs which project downward from the top section and fit into slots in the bottom section. Such a mechanism does not provide the necessary holding strength.

Thus, there is a need for a vault whose sections are simply, yet securely locked together without the possibility of accidental separation. Moreover, this bond, although strong, should not be permanent and should be detachable without damage to the vault section.

SUMMARY OF THE INVENTION

The inventive underground vault is formed of a first and second housing section. Each housing section is circular in cross-section and has an open end essentially of the same diameter. Each open end is bordered by an outwardly projecting annular flange. The flanges are sized and located to permit their mutual confrontation to form an enclosure.

Each section flange has a plurality of circumferentially located preferably equally spaced hooks and slot configurations. Thus, in the preferred form, each first and second section flange has three hooks and three slot configurations which alternate and are spaced 60° from each other. The slot configurations include an opening through the flange, a recess spaced from the opening, and a camming surface located between the opening and the recess. The surface is inclined and sloped upward from the opening to the top of the recess.

The hooks include a bight, a segment which axially offsets the bight from the flange, and a segment which circumferentially offsets the bight from the axial offset segment.

The openings are sized to permit the hooks to pass therethrough. The recess is spaced no further from the opening than the bight is circumferentially spaced from the axial offset segment.

To lock the sections together, the first and second section flanges are positioned so that the hooks and openings of one section are aligned with corresponding openings and hooks of the other section. The sections are then drawn together with the hooks passing through their corresponding slots until the flanges are contiguous. The sections are then rotated with respect to each other. This causes the bight of the hooks to upwardly transverse the camming surface. When a bight is positioned above a recess, it drops down into the recess. The recess has an inclined sidewall which aids in directing the bight of the hooks into the recess. A vertical wall which forms one side of the recess abuts the bight, once it is positioned within the recess and prevents the bight from disengaging. The sections are thereby securely locked together and cannot be easily separated. In order to effect separation, the bights are pried over the abutting walls of the recesses. This can be done without damage to the structure but does not occur accidentally.

The inventive device provides a simple but effective means of securely locking the two sections together. The locking mechanism requires no external assemblies which can obstruct deployment of the vault or become subject to deterioration. Moreover, the sections can be separated without damage to the vault.

These and other advantages will be evidenced and clarified in the discussion below and with reference to the following drawings in which.

DETAILED DESCRIPTION OF THE PREFERRED EMBODIMENT

Figure 1:
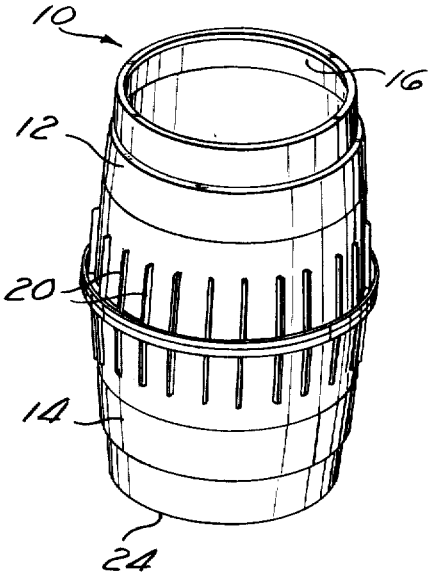
FIG. 1 is a perspective view showing both sections of the underground vault locked together.

Referring to FIG. 1, an underground vault 10 is shown which is suitable for housing structures such as transformers, pumps and the like. The vault 10 is composed of a top housing section 12 and a bottom housing section 14. The top and bottom sections 12, 14 are made of a material which is sufficiently strong and rigid to provide adequate protection for the enclosed structure. A material found particularly satisfactory is high-density polyethylene.

Figure 2:
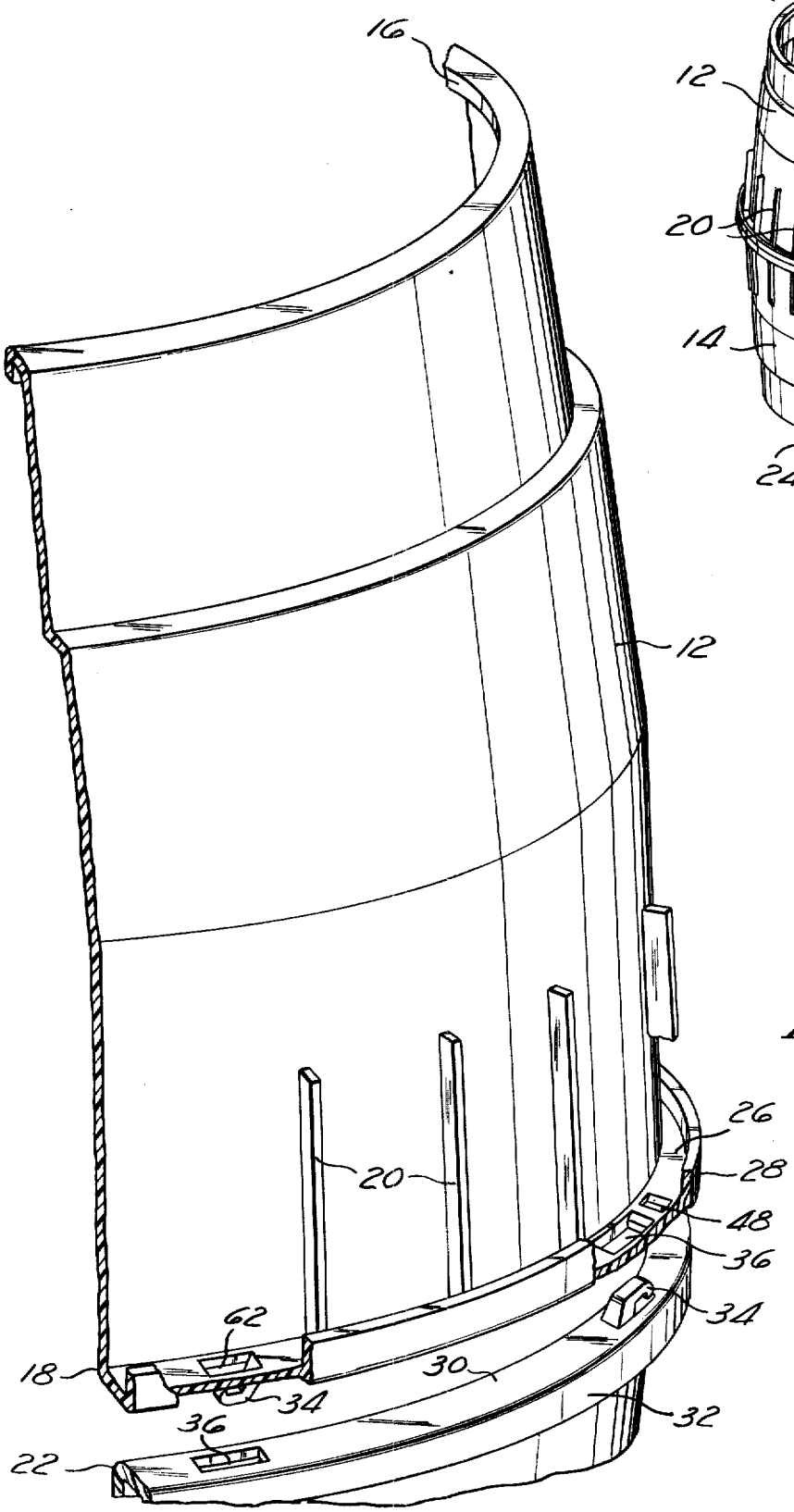
FIG. 2 is a fragmentary perspective view showing a portion of the top housing section in locking alignment with a portion of the bottom housing section.

Referring to FIGS. 1 and 2, the top housing section 12 has an open top 16. The top housing section 12 is of generally circular cross section and tapers from the circular open top 16 in stepwise fashion to an open end 18 which is of larger diameter than the open top 16. Vertically oriented circumferentially spaced ribs 20 project radially outward from the exterior housing of the top housing section 12. In a like manner, the bottom housing section 14 has an open end 22 which is of generally circular cross section and tapers in stepwise fashion to a bottom 24 of smaller diameter. These configurations are, however, not critical.

The open end 18 of the top housing section 12 is bordered by an outwardly projecting annular flange 26. The outer circumference of the annular flange 26 is bordered by a rim 28 which projects vertically upward from the flange 26. In a like manner, the open end 22 of the bottom housing section 14 is bordered by an outwardly projecting annular flange 30. The outer circumference of the flange 30 is in turn bordered by a rim 32 which projects vertically downward from the open end 22. The annular flanges 26, 30, as well as the rims 28, 32, are preferably formed of high-density polyethylene and are integrally formed with their respective housing sections 12, 14.

The diameter of the top and bottom open ends 18, 22 is essentially the same. Typically, the radial length of the top and bottom annular flanges 26, 30 is also essentially the same. When the top and bottom housing sections 12, 14 are brought together, the top and bottom annular flanges 26, 30 mutually abut. The top and bottom housing sections 12, 14 form an enclosure which surrounds the transformer that is buried in the ground. The open top 16, in use, will be covered with a frustoconical cap which is in turn covered by a grate above ground level to allow maintenance personnel access to the buried transformer.

The top and bottom annular flanges 26, 30 have a plurality of alternating circumferentially located and equally spaced hooks 34 and slot configurations 36. In the preferred embodiment, each annular flange 26, 30 has three of the hooks 34 and three of the slot configurations 36 which alternate and are circumferentially spaced 60 degrees from the adjacent slot or hook.

Figure 3:
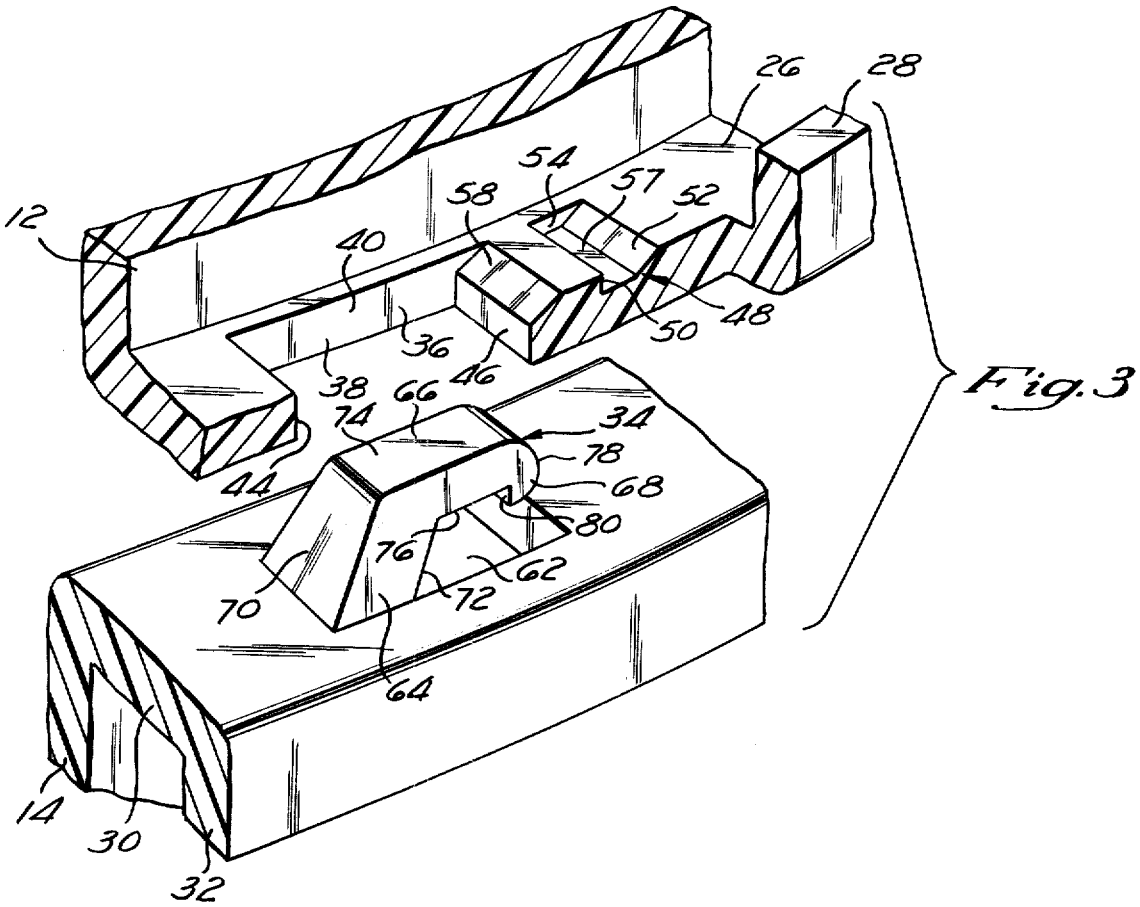
FIG. 3 is an enlarged fragmentary perspective view showing a slot configuration on the top housing section in locking alignment with a hook from the bottom housing section.
Figure 4:
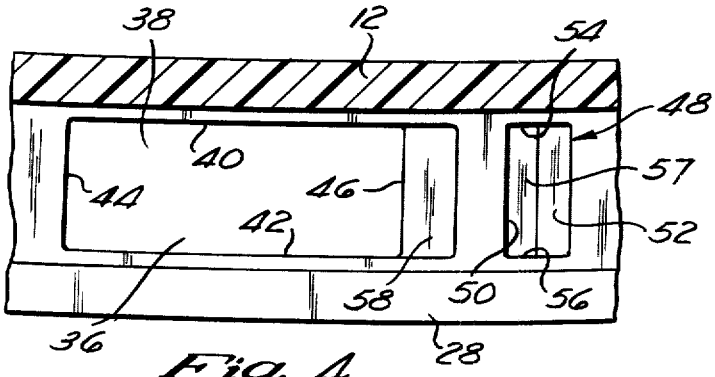
FIG. 4 is a top view of the slot configuration shown in FIG. 3.
Figure 5:
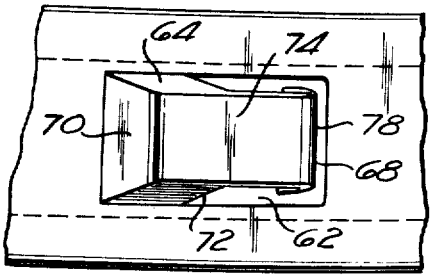
FIG. 5 is a top view of the hook shown in FIG. 3.

Referring to FIG. 3, a typical slot configuration 36 located on the top housing section 12 is shown in mating alignment with a hook 34 on the bottom housing section 14. The slot configuration 38 is composed of a generally rectangular opening 38 which extends through the thickness of the flange 26. The width of the opening 38 is slightly less than the radial length of the flange 26 and the length of the opening 38 in the preferred embodiment is approximately 2.25 inches. Referring to FIGS. 3 and 4, the opening 38 is formed by back wall 40, front wall 42 and side walls 44 and 46. The depth of the opening 38 at its deepest portion which is equal to the thickness of the flange 26 in the preferred embodiment is 0.35 inches. The side wall 46 is only 0.25 inches in height in the preferred embodiment.

Located proximal to the opening 38 is a recess or trough 48 which is formed by a vertical side wall 50, an inclined side wall 52, a back wall 54, a front wall 56 and a bottom 57. In the preferred embodiment, the height of the vertical side wall 50 is 0.125 inches, the total width of the recess is 0.375 inches, and the width of the bottom 47 is 0.1875 inches.

Located between the vertical wall 46 of the opening 38 and the recess 48 is a camming surface 58. The camming surface 58 rises at an angle of about 20 degrees from the vertical wall 46 to the top of the flange 26. Since the camming surface 58 does not extend to the vertical wall 50 of the recess 48, a rectangular section of flange 60 is formed between the camming surface 58 and the recess 48. In the preferred embodiment, the distance between the vertical wall 48 and the vertical wall 50 is 0.6875 inches and the distance between the vertical wall 46 and the flange section 60 is 0.375 inches.

Referring now to the bottom housing section 14 in FIG. 3, the bottom annular flange 30 has an essentially rectangular opening 62 extending therethrough. The hook 34 projects upward from the opening 62 by means of an axial offset segment 64 which extends axially upward from the flange 30. The axial offset segment 64 extends into a horizontal circumferential offset segment 66 which ends in a bight 68.

The axial offset segment 64 is essentially trapezoidal in section and is formed by a back inclined wall 70 and a front inclined wall 72. The axial offset segment 64 projects axially upward from the flange 30 and is formed by a top wall 74 and a bottom wall 76. The circumferential offset segment 66 circumferentially spaces the bight 68 from the axial offset segment 64.

The bight 68 is formed by a rounded nose 78 which projects below the bottom wall 76 of the circumferential offset segment 66 forming a vertical gripping wall 80.

In the preferred embodiment, the thickness of the flange 30 is 0.35 inches. The distance between the lowest portion of the nose 78 and the flange 30, which is a measure of the total axial offset of the bight 68, is 0.30 inches. The bight of the vertical wall 80 of the bight 68 is 0.10 inches. The distance between the vertical wall 80 and the line of intersection between the front wall 72 of the axially offset segment 64 and the bottom wall 76 of the circumferential offset segment 66 is 0.75 inches. This is a measure of the circumferential offset of the bight 68 from the axial offset segment 64. The distance between the vertical wall 80 of the bight 68 and the end of the rounded nose 78 is 0.25 inches. The total length of the hooks 34 measured from the end of the nose 78 to the point at which the back wall 70 interfaces with the flange 30 is 2.00 inches. The horizontal distance measured between the points at which the back and front walls 70, 72 of the axial offset segment 64 intersects the flange 30 is 0.50 inches.

The distance between the top and bottom walls 74, 76 of the circumferential offset segment 66 is 0.375 inches.

Figure 6:
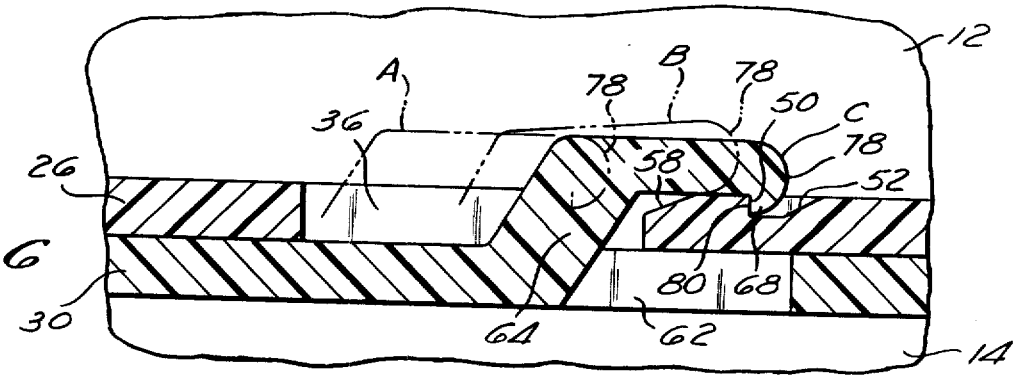
FIG. 6 is a side sectional view showing the hook and slot configurations of FIG. 3 during the locking process.

Referring to FIGS. 3 and 6, a method of mutually locking the top and bottom housing sections 12, 14 will now be described. To prepare for the locking, the top and bottom housing sections 12, 14 are aligned so that the hooks 34 of one section are aligned with the openings 38 of the other section. This mating alignment is shown in FIG. 2 in which two corresponding pairs of hooks and slot configurations are shown. In the preferred embodiment, there are six pairs of mating hook and slot configurations.

With the top and bottom housing sections 12, 14 in correct alignment, they are drawn together until the flanges 26, 30 are contiguous. This is made possible since the openings 38 are sized to permit the hooks 34 to pass therethrough. Referring to FIG. 6, the configuration in which the hook 34 extends through the opening 38 with the flanges 26, 30 in abutting relation is shown in phantom and labeled "A".

In order to lock the vault, the top and bottom housing sections 12, 14 are rotated with respect to each other in a single direction. As illustrated in FIGS. 2 and 6, the top housing 12 is rotated in a clockwise direction with respect to the bottom housing section 14. As the sections rotate, the nose 78 of the bight 68 contacts the camming surfaces 58. In order to permit this, the axial offset distance of the bight 68, i.e., the distance between the end of the nose 78 and the flange 30, must be greater than the vertical height of the vertical wall 46 of the opening 38, and must be less than the thickness of the section of flange 60.

As the housing sections 12, 14 continue to be mutually rotated, the bight 68 upwardly transverses the camming surface 58 until it reaches the flat section of flange 60 located between the camming surface 58 and the recess 48.

The position in which the bight 68 is contiguous with the section of flange 60 is shown in phantom in FIG. 6 and labeled "B". In the B position, the hook 34 is resiliently flexed in an upward direction from its original shape, i.e., the bight 68 is axially spaced from the flange 30 a distance greater than its original distance. In the preferred embodiment, the hooks 34 are made of high density polythelyene which can accept such flexing without splitting or damaging the hooks.

As the sections 12, 14 continue to be mutually rotated, the bight 68 horizontally transverses the section of flange 60 until it is positioned above the recess 48. Once the vertical wall 80 of the bight 68 clears the vertical wall 50 of the recess 48, the bight 68 snaps down into the recess 48. This snapping action, which facilitates the locking, results from the memory of the polyethylene which causes the hook 34 to return to its original shape. The bight 68 is therefore axially offset from the flange 30 a distance approximately equal the thickness of the flange 26 at the deepest portion of the recess 48.

The position in which the bight 68 is located within the recess 48 is shown in FIG. 6 and labeled "C". In the C position, the vertical wall 80 of the bight 68 abuts the vertical wall 50 of the recess 48, thereby locking the bight 68 within the recess 48. In order to permit this mutual abutment, the distance between the vertical wall 46 and the vertical wall 50 should not be greater than the distance the vertical wall 80 of the bight 68 is circumferentially offset from the axial offset segment 64. The inclined sidewall 52 of the recess 48 serves to direct the bight 68 into the deepest portion of the recess 48 and into abutment with the vertical wall 50.

In the C position, the top and bottom housing sections 12, 14 are securely locked to each other. Yet, no external assemblies are required which can deteriorate or loosen over time.

Although the circumferential offset distance of the bight 68 from the axial offset segment 64 is greater than the distance between the vertical wall 46 and the vertical wall 50, it is not great enough to permit the bight 68 to disengage from the recess 48 upon continued mutual rotation of the sections 12, 14. Thus, once the lock has been affected, the sections 12, 14 cannot be separated by their mutual rotation. Although the sections 12, 14 cannot be easily separated, separation can be accomplished by prying the bights 68 of the hooks 34 over the respective vertical walls 50 of the recesses 48.

What is claimed is:

1. An underground vault comprising:

a first housing having an open end;

a second housing having an open end and an annular flange which projects outwardly from the exterior of said second housing;

said first housing having a resiliently deformable hook depending from said open end;

said flange having an opening extending therethrough, said opening being of a size sufficient to permit said hook to pass through it;

said flange having a recess located proximal to said opening, and a camming surface, between said recess and said opening;

said hook having means for engaging said recess, said engaging means, upon mutual rotation of said housings, traversing said camming surface to engage said recess and lock said housings together; and said camming surface resiliently deforming said hook in a plane parallel to the direction of motion of said hook as it traverses said camming surface.

2. An underground vault comprising:

a first section having an open end which is bordered by an outwardly projecting annular flange;

a second section having an open end which is bordered by an outwardly projecting annular flange;

said first and second section flanges being sized and located to permit their mutual confrontation to form an enclosure;

said first section flange having a projecting hook;

said second section flange having an opening therethrough, a recess spaced from said opening and a camming surface located between said opening and said recess, said surface inclining upwardly in the direction of said recess;

said hook comprising a bight, an axially offset segment projecting from said first section flange, and a circumferentially offset segment connecting said axially offset segment and said bight;

said opening being sized to permit said hook to pass therethrough;

said recess being spaced from said opening no further than said bight is circumferentially offset from said axial offset;

said recess having a wall for abutting said bight after said bight is located within said recess to prevent said bight from disengaging from the recess; and said first and second sections being mutually rotatable to permit said bight, after having passed through said opening, to traverse said camming surface and be directed into said recess and abut said wall, said circumferential offset segment bridging said camming surface when said bight is in said recess.

3. The device of claim 2 wherein said bight is axially offset from said first section flange a distance less than the largest thickness of said second section flange between said recess and said opening.

4. The device of claim 2 wherein said bight is axially offset from said first section flange a distance approximately equal to the thickness of the second section flange at the deepest portion of said recess.

5. The device of claim 2 wherein said bight is axially offset from said first section flange a distance less than the largest thickness of said second section flange between said recess and said opening and a distance greater than the thickness of said second section flange at the lower portion of said camming surface.

* * * * *